United States Patent [19]

Nijhawan et al.

[11] 4,356,064

[45] Oct. 26, 1982

[54] FUMES CONTROL SYSTEM DUCT AND CAR ARRANGEMENT

[75] Inventors: Pramodh Nijhawan, Indianapolis; Joseph M. Duckworth, Zionsville, both of Ind.

[73] Assignee: The Bahnson Company, Winston-Salem, N.C.

[21] Appl. No.: 19,650

[22] Filed: Mar. 12, 1979

[51] Int. Cl.[3] ..... C10B 33/00

[52] U.S. Cl. ..... 202/263; 203/242

[58] Field of Search ..... 202/263, 242, 270, 254, 202/255, 256; 159/DIG. 35

[56] References Cited

U.S. PATENT DOCUMENTS

| | | | |
|---|---|---|---|
| 1,329,129 | 1/1920 | Macintosh et al. | 202/255 |
| 3,729,384 | 4/1973 | Kinzler et al. | 202/263 |

*Primary Examiner*—Norman Yudkoff

*Attorney, Agent, or Firm*—Dann, Dorfman, Herrell and Skillman

[57] ABSTRACT

A fumes control system duct-and-car arrangement for a duct including a wall portion closed by a flexible web, and a support structure in the duct under the web to prevent collapse of the web into the duct under evacuation includes a car disposed for movement along the duct to raise the web and couple the interior of the car to the interior of the duct. The car is provided with a door which can be opened to gain access to the interior of the car. The support structure for the web provides an access way so that maintenance and inspection personnel can move from the interior of the car into the interior of the duct. Various types of apparatus for moving the car along the duct include a motor mounted on the car and a wheel supporting the car from the duct and driven by the motor. Another motive mechanism provides a motor mounted beyond one of the limits of travel of the car along the duct, and a flexible cable, chain or the like, pulled by actuation of the motor to move the car along the duct.

4 Claims, 10 Drawing Figures

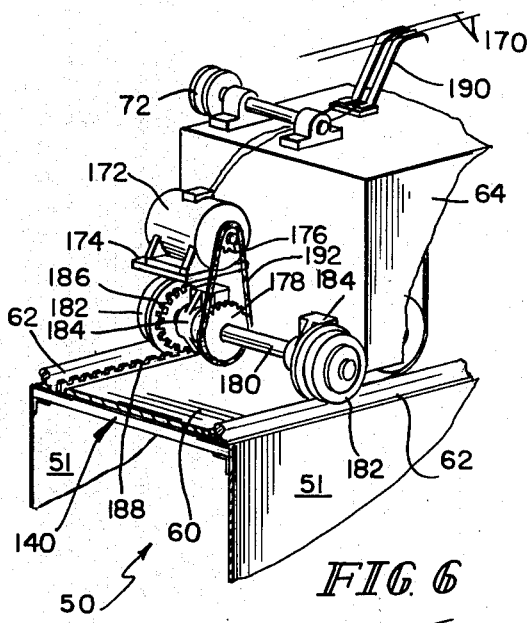
FIG. 6
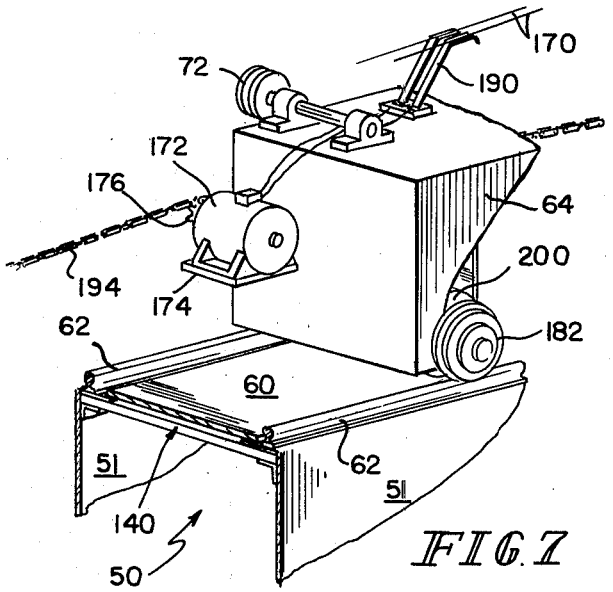
FIG. 7
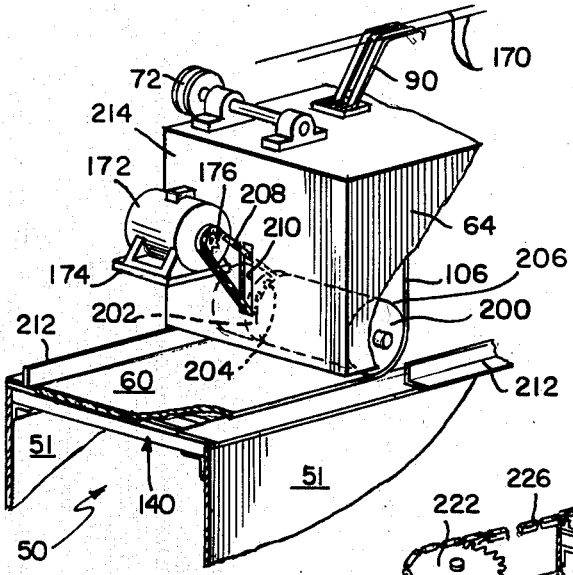
FIG. 8
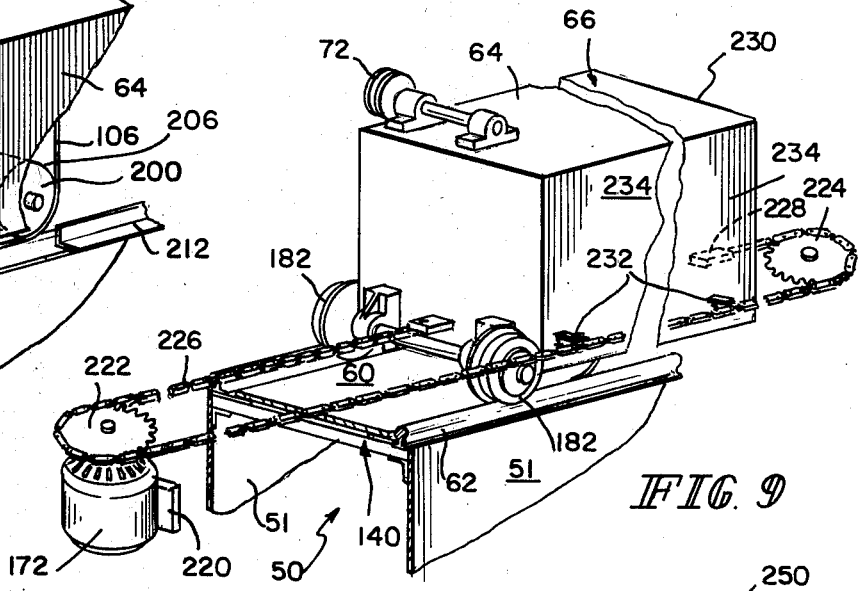
FIG. 9
FIG. 10
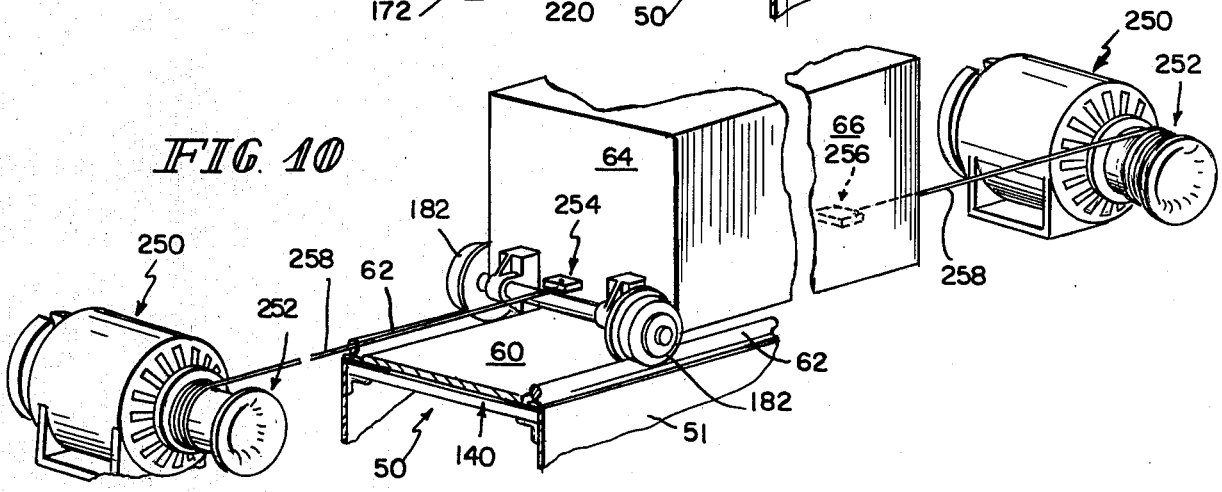

FUMES CONTROL SYSTEM DUCT AND CAR ARRANGEMENT

This is a related application to the co-pending applications of the same inventors, assigned to the same assignee as the instant application, filed of even date herewith (i.e., Mar. 12, 1979), and having the following U.S. Ser. Nos.: 019,651; 019,434; 019,464 and 019,440.

This invention relates to pollution control, and primarily to a close-capture system for containing airborne contaminants such as those generated during a coke pushing operation in an oven of a coke oven battery.

Many industrial operations, such as coke pushing operations, generate large quantities of pollutant fumes and dusts. In a coke pushing operation, coke is pushed from a selected oven of a coke oven battery by a large ram through an oven door opening on one side (the so-called coke side) of the oven, through a coke guide and into a receptacle or conveyor, illustratively a so-called quench car or hot car. The hot, usually incandescent coke is transported in this receptacle or conveyor to a quench station, which may take the form of a quench tower or quench bath, in which the coke is drenched or submerged.

Several systems for capturing pollutants generated during transfer of the coke from the oven to the quench station are known. In some systems, such as those described in U.S. Pat. Nos. 3,630,852 and 4,050,992, the entire coke side of the battery, or a substantial portion of it, is enclosed in a shed all the way down to the wharf upon which quenched coke is dumped. The entire shed is continuously or intermittently evacuated, illustratively through an overhead duct system which draws an enormous volume of pollutant-laden air from the interior of the shed. Of course, an equally enormous blower and large capacity filter system must be provided to accomodate the large volume of pollutant-laden air withdrawn from the shed interior.

The expense of such a system is evident. First, coke oven batteries typically are quite large. Thus, the shed itself must be quite large. Since there is no way of controlling the dispersal of pollutant dust and fumes within the interior of the shed, the ventilation system must be able to withdraw completely the entire volume of air within the shed over a predetermined, relatively brief span of time. Thus, in addition to the high cost of constructing the large shed on the coke side of the battery, a high-capacity ventilation system, typically including large inlet ducts, large blowers and high-capacity filter mechanisms (such as precipitators, scrubbers or bag houses) must be provided.

In other alternative systems, such as that illustrated in U.S. Pat. No. 4,029,551, a large hood carried by the coke guide-supporting car is connected through a flexible duct system of the general duct-and-car type illustrated in U.S. Pat. No. 4,069,108, for continuous or intermittent evacuation. of course, in a system of that type, the coke guide-supporting car must travel to the quench station with the quench car to insure that airborne pollutants released between the push and entry of the quench car into the quench station are captured.

In a third type of system, illustrated in U.S. Pat. No. 3,675,400 a separate car, riding upon the same rails as the quench car, supports, in cantilever fashion, a hood designed to overlie the entire length of the quench car when the separate car is close to the quench car, and progressively less of the quench car as the separate car moves away from the quench car. Of course, the separate car must also be flexibly connected to a continuous or intermittent evacuation system. Placement of the ventilation system-supporting car on the same tracks as the quench car is extremely inconvenient, since it does not permit the ventilation system-supporting car to pass the quench car.

In another prior art system, the coke guide is surmounted by a hood. A quench car hood is separately mounted for movement along a pair of vertically spaced tracks supported above, and adjacent, the quench car tracks. The coke guide hood is supported for movement along the coke side of the battery from an overhead track lying vertically above the coke guide locomotive tracks. A continuously ventilated duct-and-car arrangement, of the general type described in U.S. Pat. No. 4,069,108, is disposed laterally along the coke side, with the coke guide locomotive tracks, the overhead coke guide hood supporting track, the quench car tracks, and the quench car hood-supporting tracks and framework located between the coke side of the battery and the duct-and-car arrangement. Separate ducts connect the coke guide hood and quench car hood to the car of the duct-and-car arrangement. The conduit connecting the quench car hood to the car of the duct-and-car arrangement includes a regenerative heat exchanger.

Typically, the quench car hoods of coke oven installations are fairly massive. Thus, it will be appreciated that, in order to support the quench car hood in such cantilever fashion, the wheels on the quench car hood, the vertically spaced tracks engaged by such wheels, and the framework supporting such tracks must be of fairly heavy and strong construction. Additionally, a separate framework, equally as sturdy as the one supporting the quench car hood, is provided to support the duct of the duct-and-car arrangement well above the level of the quench car tracks and out of interference with the unloading operation from the quench car onto the wharf. A system of this last-described type is offered jointly by Hartung, Kuhn & Co. Maschinenfabrik GmbH, Dusseldorf, and Firma Carl Still, Recklinghausen, both of West Germany.

Yet another type of system is illustrated by British Patent specification No. 1,310,980. In systems of this type, a collapsible hood expanded and contracted by a fluid motor is provided around the coke guide to collect dusts and fumes generated during the push. A duct-and-car arrangement is used to evacuate the collapsible hood. In this embodiment, the car is inside the duct, and the duct is supported above the coke guide locomotive on a suitable support frame. An apparent weakness of the systems of this type is that no separate hood mechanism is provided for close capture of contaminants released from hot coke in the quench car after the push. Therefore, to insure capture of such contaminants, the coke guide locomotive must always accompany the quench car. Further, the coke guide hood must be sufficiently long to cover the entire length of the quench car. In very many situations, such requirements for adequate ventilation make installations of this type prohibitively expensive.

According to the invention, a contaminant control system includes suction means, a duct and means for coupling the suction means to the duct for evacuation thereby. The duct is of a type including a wall portion closed by a flexible web, means, such as a grate, for supporting the web against collapse into the duct under such evacuation, and a car disposed for movement along the duct to raise the web to couple the interior of the car to the interior of the duct. Means are provided for guiding the car along the duct. A hood or the like couples the interior of the car to an area containing contaminants to be evacuated. The car includes means cooperating with the guide means to support and guide the car along the duct, and a door for providing access to the interior of the car for entry into the duct for inspection.

Alternatively, a second car may be provided for movement along the duct, the second car including means for raising the web to couple the interior of the second car to the interior of the duct, and a door for providing access to the interior of the second car for entry into the duct for inspection.

Further according to the invention, a contaminant control system includes suction means, a duct, and means for coupling the duct to the suction means for evacuation thereby. The duct includes a wall portion closed by a flexible web. A car is disposed for movement along the duct to raise the web to couple the interior of the car to the interior of the duct. Means are provided for supporting and guiding the car along the duct. Means are provided for moving the car along the duct to a selected position. The moving means includes a motor, a drive wheel, means for engaging the drive wheel, means for attaching the drive wheel engaging means to the car, means for mounting the drive wheel, and means for coupling the motor to the drive wheel. The motor is actuable selectively to drive the drive wheel to move the drive wheel engaging means, and thus the car, along the duct.

The invention may be best understood by referring to the following description and accompanying drawings which illustrate the invention. in the drawings.

Figure 1:
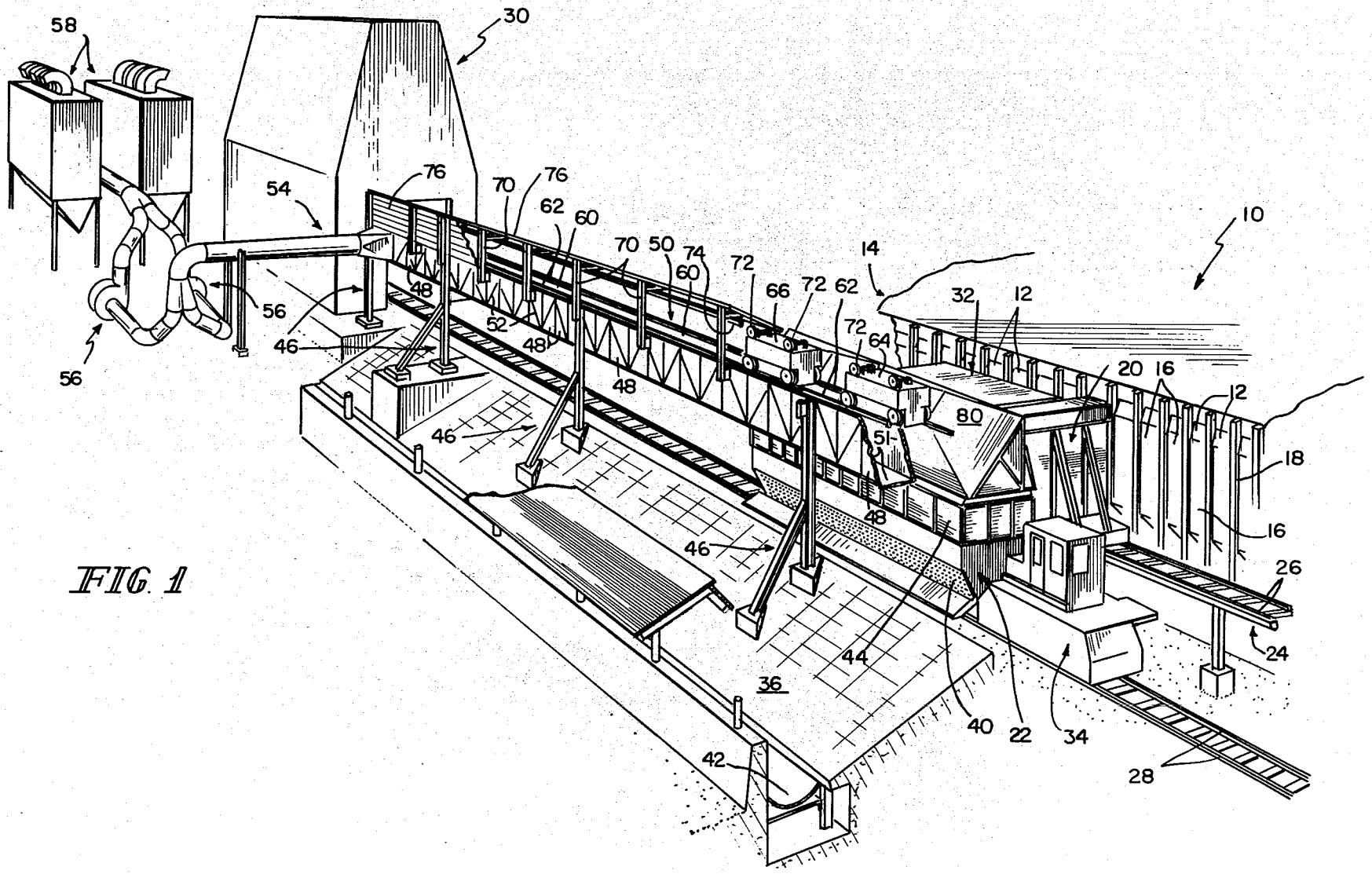
FIG. 1 is a partly fragmentary prespective view of a typical coke oven battery installation, with the close-capture contaminant control system of the instant invention installed.
Figure 2:
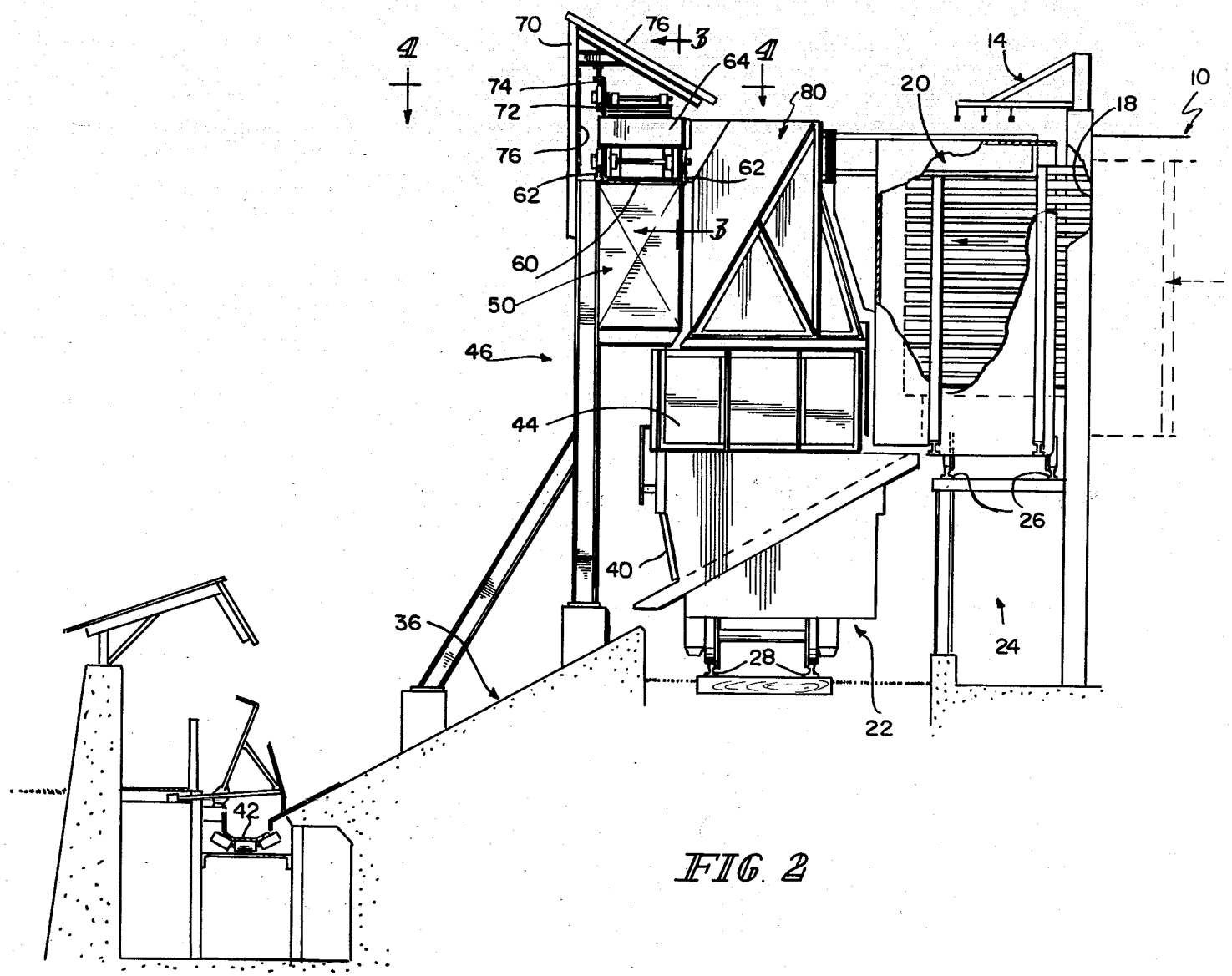
FIG. 2 is a partly fragmentary end elevational view of the installation of FIG. 1.

Referring now particularly to FIGS. 1–2, a coke oven battery 10 consists of several coke ovens 12 in parallel. Each oven 12 is provided at its coke side end 14 with a door 16, and at its push side end (not shown) with a ram for pushing coke through the oven from the ram side to the coke side 14 to empty the oven. The oven 12 is emptied through its door opening 18 and a coke guide 20 into a waiting quench car 22. The coke guide 20 is movable along a master gallery 24 on railroad-type rails 26 to align it with a selected oven 12 to be emptied. Similarly, the quench car 22 is movable along the coke side 14 of the oven battery 10 to receive the coke pushed through the guide 20. The quench car 22 is movable on railroad-type rails 28 which extend along the coke side and to a quenching station 30, illustratively, a quenching tower. The means for moving the coke guide 20 to a selected oven 12 is a door machine locomotive 32 movable on rails 26. This machine 32 incorporates the function of supporting and moving the coke guide with the function of removing the door 16 from the selected oven 12 and replacing the door after a push is completed. The quench car 22 is moved by a locomotive 34 mounted on the rails 28.

An unloading wharf 36 is provided adjacent the rails 28 to permit quenched coke from station 30 to be unloaded through a door 40 on quench car 22 and gravity-fed to a continuous coke conveyor belt 42. Coke conveyor belt 42 transfers the finished coke to a storage area. The door 40 is perforated to permit the water used to quench the coke in car 22 to drain from the car 22.

Quench car 22 also includes extended side walls 44 which increase the vertical height of the quench car 22 up to the vertical height of the top of the locomotive 34.

The ventilation, or pollution evacuation, system for the pushing operation includes a longitudinally spaced series of support posts or pillars 46 anchored in the wharf 36 adjacent rails 28. Each pillar 46 supports a longitudinally extending section 48 of a first duct 50. Each section 48 includes its own supporting framework 52 which cooperates with a respective pillar 46 to make each section 48 generally self-supporting. Each section 48 is coupled in sliding, substantially air-tight sealing engagement with its adjacent duct sections 48. This sectional arrangement permits relatively unimpaired thermal variations in the length of each section 48 without adversely affecting the total length of the duct 50. Transition and connector duct sections 54 at one end of the first duct 50 couple the interior of duct 50 through suction means 56 to an assembly, such as a bag house, fume scrubber or separator 58. Dust and fumes from the hot coke are separated at station 58 and clean air is exhausted to atmosphere.

The duct 50 is generally rectangular in transverse section, and includes three rigid walls 51 supported in the framework 52, and an upper wall section which is closed by a flexible web or belt 60. The vertically upper edges of the vertically extending wall of duct 50 are provided with rails or tracks 62 supporting substantially identical, belt-lifting first and second cars 64, 66 for movement along duct 50. The operation of the cars 64, 66 on duct 50 is generally as described in U.S. Pat. Nos. 2,923,227, 3,478,668, 3,481,265, 3,698,137 3,705,545, 3,788,208, and 4,086,847, as well as the above-identified British patent specification No. 1,310,980, and U.S. Pat. Nos. 4,029,551, 4,069,108.

Vertically extending supports 70 are attached to the framework 52 so as to avoid interference with movement of the cars 64, 66 along tracks 62. Each car 64, 66 includes a pair of upper wheels 72. Supports 70 support a track 74 which is engaged by wheels 72 of each car. Supports 70 also support a pent roof 76 which protects wheels 72, tracks 74 and the web or belt 60 from weather.

The contaminant capture system includes a mobile hood 80 supported from cars 64, 66 for movement along duct 50 in overlying relation with a selected portion of quench car 22.

Figure 3:
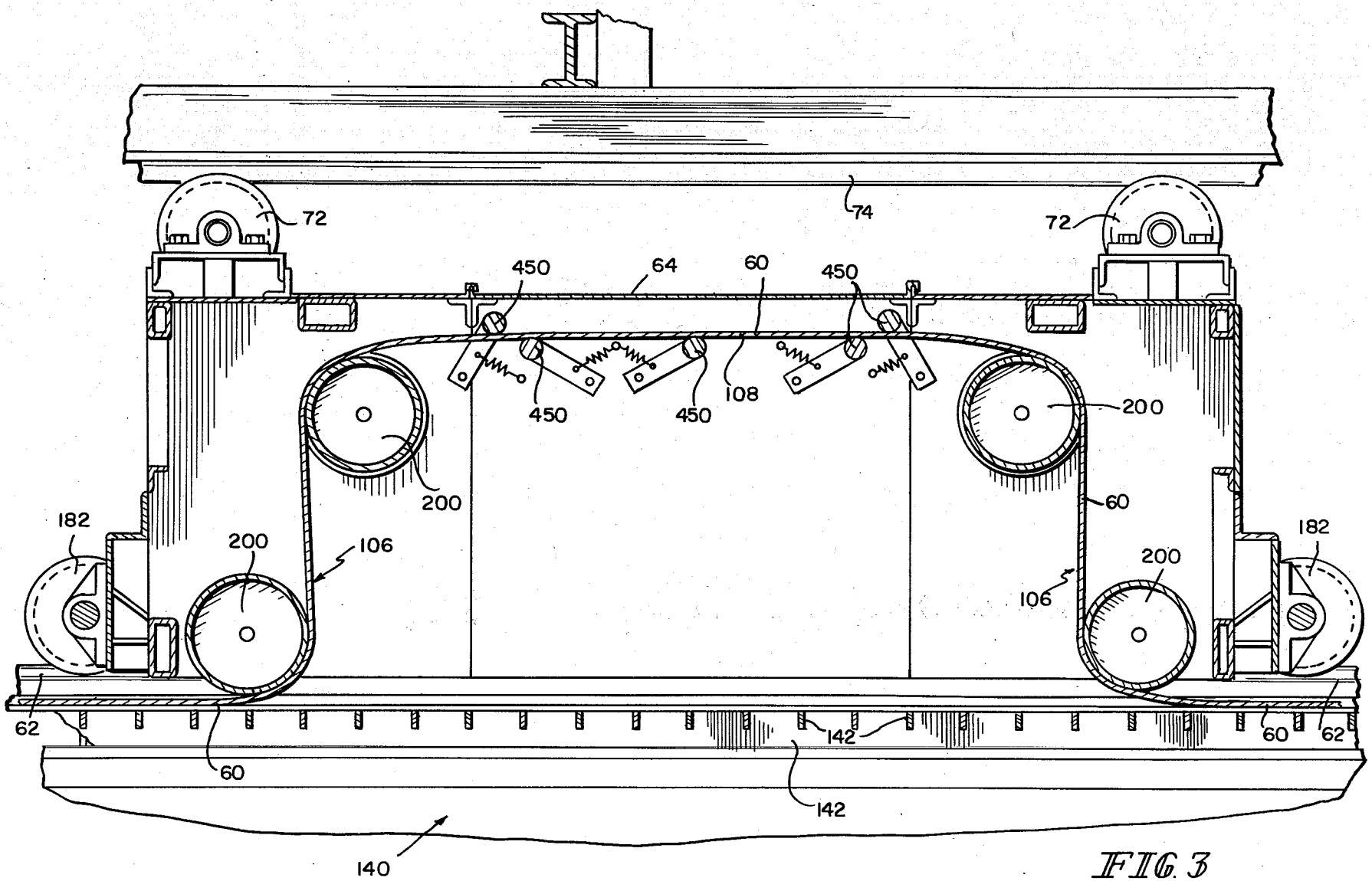
FIG. 3 is a fragmentary sectional view of a detail of FIGS. 1–2, taken generally along section lines 3—3 of FIG. 2.
Figure 4:
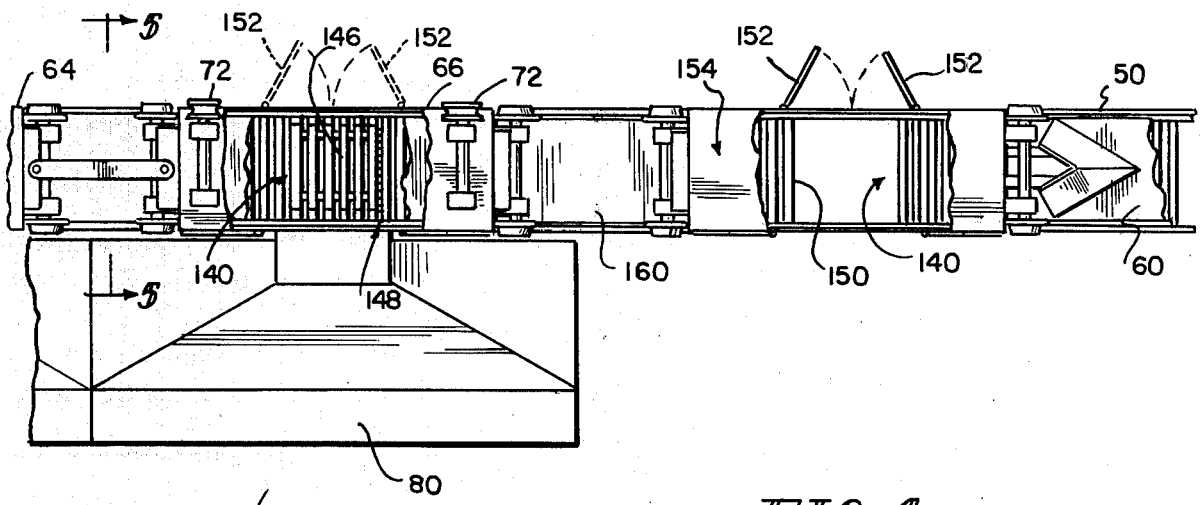
FIG. 4 is a fragmentary sectional view of a detail of the system taken generally along section lines 4—4 of FIG. 2.
Figure 5:
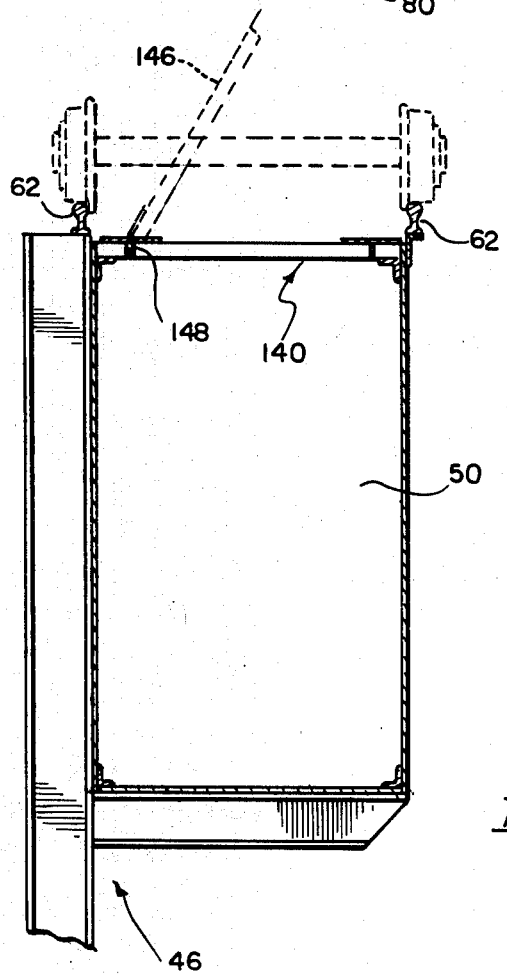
FIG. 5 is a sectional view of a detail of the system, taken generally along section lines 5—5 of FIG. 4, but illustrating an alternative to structures illustrated in FIG. 4; and, FIGS. 6–10 illustrate a number of drive arrangements for systems of the type illustrated in FIGS. 1–2.

As best illustrated in FIGS. 3–5, a support means 140 is provided in the duct 50 directly beneath the web 60. The illustrative web support means 140 can be a grate 142 (FIG. 3), or transversely extending slats 144 (FIGS. 4–5), or other suitable means. Occasionally, it is necessary or desirable to enter the interior of duct 50 for inspection purposes, for maintenance, or the like. To accomplish this, the support means 140 can include a section 146 attached by a hinge 148 to the surrounding support means 140 portion (see FIGS. 4 and 5). Alternatively, the web support means 140 can include adjacent support means sections separated to define an access space 150, as illustrated in FIG. 4.

Car 66 (FIG. 4) includes access doors 152. Movement of cars 64, 66 into position such that car 66 lifts the web 60 from the section 146 or access space 150, followed by opening of the doors 152, permits inspection and/or repair personnel to enter the duct 50 directly.

Alternatively, as illustrated in FIG. 4, a separate and independently movable inspection car 154 has access doors 152 and interior rollers to lift the web 60 from the support means 140. The inspection car 154 can be stored at the end of the duct 50 when not in use.

Turning now to FIGS. 6–10, several arrangements for driving cars 64, 66, as well as inspection car 154, along the duct 50 are illustrated.

In FIG. 6, electrical connections are made to the car 64 from overhead buses 170. An electric motor 172 is mounted on a brcket 174 at the end of the car 64. A small sprocket 176 is mounted on the motor 172 output shaft. A sprocket 178 is mounted on the axle 180 upon which the track 62 engaging wheels 182 are mounted. The sprocket 178 is mounted between the bearings 184 by which the axle 180 is rotatably attached to the car 64 body. One of wheels 182 is cut to provide pinion gear-like teeth 186. One of the tracks 62 is provided with longitudinally extending rack-like teeth 188. Actuation of motor 172 may be by any suitable means, such as, for example, switching of power to buses 170. Contact is maintained between buses 170 and the motor 172 through spring-urged contact brushes 190 mounted on top of the car 64.

Sprockets 176, 178 are coupled by a roller chain 192. The direction of motion of the car 64, and therefore, the hood 80, along duct 50 can be reversed, for example, by reversing the polarity of the potential across buses 170.

In FIG. 7, the sprocket 178 is replaced by a roller chain 194 which extends the entire length of travel of the car 64 along duct 50. The electric motor 172 is positioned so that sprocket 176 projects beyond the side wall of car 64 to engage the roller chain 194. Rotation of motor 172 in a first direction pulls the car 64 along duct 50 in one direction. Reversal of motor 172, such as by reversal of the polarity of the voltage on buses 170 pulls car 64 along duct 50 in the opposite direction. In this manner, cars 64 and 66, and hood 80 (see FIGS. 1–2) can be positioned along the coke side 14 of battery 10 as desired.

Referring to FIG. 8, the track 62 and the associated wheels 182 are avoided. Rather, one of the belt directing rollers 200 is provided with an annular groove 202. A sprocket 204 is positioned in the groove so that the teeth of the sprocket 204 lie well below the belt-contacting surface 206 of the roller 200. A roller chain 208 is trained about the sprocket 176 of an electric motor 172 and about the sprocket 204 in groove 202. Chain 208 passes through a slot 210 in the side wall of car 64. Actuation of the motor 172 in a first direction drives the belt roller 200 to pull the car 64, and the hood 80 along web 60. Of course, in this embodiment, sufficient friction must exist between the belt contacting surface 206 and the web 60 to overcome the inertia of hood 80 and associated components. The car 64 is guided along the web 60 by the guide strips 212 positioned on both sides of the duct 50 at the vertically upper extents of the duct 50 side walls 51. It will be appreciated that the region of the car 64 interior between the vertical run 106 of web 60 and the car 64 sidewall 214 in which slot 210 is provided is isolated from the evacuated volume of car 64 by the vertical run 106 itself.

In the embodiment illustrated in FIG. 9, the electric motor 172 is mounted adjacent one end of the duct 50 on a mounting bracket 220. A drive wheel sprocket 222 is mounted on the motor 172 shaft. An idler wheel sprocket 224 is mounted adjacent the other end of the duct 50. Sprockets 222, 224 are thus mounted beyond the limits of travel of car 64 along duct 50 to avoid interference with the travel of car 64 along duct 50. A length 226 of roller chain is attached at one of its ends to sidewall 214 of car 64, and at its other end, at 228, to the sidewall 230 of car 66. Small roller guides 232 are mounted on the sidewalls 234 of cars 64, 66 to assist in supporting the weight of roller chain 226 between sprockets 222, 224.

In the embodiment of the invention illustrated in FIG. 10, motor 250 driven winches 252 are coupled to attachment points 254, 256 of cars 64, 66, respectively, through flexible elements, such as ropes or cables 258. Motors 250 are synchronously driven, one to pay out cable 258 from its respective inch 252, and one to take up cable 248 on its respective winch 252. This moves cars 64, 66 along rails 62 on the duct 50 to position hood 80 as desired. Of course, the winches 252 could be motor 250 driven in opposite directions, with clutches which disengage them from their respective winches 252 when cable 258 is being paid out. In such an embodiment, it would not be necessary to drive the motors 250 synchronously. Rather, only one motor 250 would need to be driven at any particular time.

Returning briefly to FIG. 3, it will seem that there are two different types of rollers provided within each car 64, 66. The first rollers 200, are provided primarily for directing the web or belt 60 through the car. That is, rollers 200 lift and lower the web 60 from and to the web support means 140.

As was illustrated in FIG. 8, rollers 200 may permit the elimination of the separate carriage wheels 182. Alternatively, as illustrated in FIG. 7, the vertically lower rollers 200 and carriage wheels 182 can be mounted on the same axle. It is possible to construct the axle, the carriage wheels 182 and the rollers 200 in one piece if the effective diameters of the rollers 200 and carriage wheels 182 are the same.

The second type of roller, 450, in each of cars 64, 66 is provided above and below the horizontal run 108 of the web 60 within each car 64, 66. Rollers 450 are rotatably mounted upon spring 452 urged, pivotally mounted arms 454 from the sidewalls of cars 64, 66. Rollers 450 serve to guide and stabilize the web 60, and to maintain tension on the web.

What is claimed is:

1. In a contaminant control system including suction means, a duct, means for coupling the suction means to the duct for evacuation thereby, the duct including a wall portion closed by a flexible web, the duct further including means for supporting the web against collapse into the duct under such evacuation, a first car disposed for movement along the duct to raise the web to couple the interior of the first car to the interior of the duct, means for guiding the first car along the duct, and means for connecting the interior of the first car to an area containing contaminants to be evacuated, a second car disposed for movement along the duct, and means for guiding the second car along the duct, the second car including means for raising the web to couple the interior of the second car to the interior of the duct, and a door in the second car for providing access to the interior of the second car for entry into the duct for inspection.

2. The apparatus of claim 1 in which the web support means includes adjacent web support means sections separated to define access spaces between such adjacent web support means sections for access to the interior of the duct from the interior of the second car.

3. The apparatus of claim 1 in which the web support means includes a support means section and means removably connecting said support means section to the duct, removal of said removable support means section providing access to the interior of the duct from the interior of the second car.

4. The apparatus of claim 1 in which the web support means includes a support means section and hinge means attaching said support means section to the duct, hinged movement of said support means section selectively permitting and denying access to the interior of the duct from the interior of the second car.

* * * * *